US008056533B2

(12) United States Patent
Wagner

(10) Patent No.: US 8,056,533 B2
(45) Date of Patent: Nov. 15, 2011

(54) GAS EXCHANGE VALVE ACTUATING DEVICE

(75) Inventor: Marc Oliver Wagner, Esslingen (DE)

(73) Assignee: Daimler AG, Stuttgart (DE)

( * ) Notice: Subject to any disclaimer, the term of this patent is extended or adjusted under 35 U.S.C. 154(b) by 510 days.

(21) Appl. No.: 12/286,436

(22) Filed: Sep. 29, 2008

(65) Prior Publication Data

US 2009/0139486 A1 Jun. 4, 2009

Related U.S. Application Data

(63) Continuation-in-part of application No. PCT/EP2007/002932, filed on Apr. 2, 2007.

(30) Foreign Application Priority Data

Apr. 5, 2006 (DE) ..... 10 2006 015 893

(51) Int. Cl.
*F01L 1/18* (2006.01)

(52) U.S. Cl. ..... 123/321; 123/90.46; 123/90.44; 123/90.4

(58) Field of Classification Search ..... 123/321, 123/320, 73, 90.16, 90.24, 90.27, 90.39, 123/90.4, 90.41, 90.42, 90.43, 90.44, 90.45, 123/90.46, 90.23, 90.22; 251/189, 90, 93
See application file for complete search history.

(56) References Cited

U.S. PATENT DOCUMENTS

| | | | | |
|---|---|---|---|---|
| 5,195,489 | A | 3/1993 | Reich | |
| 5,564,385 | A * | 10/1996 | Hakansson | 123/321 |
| 5,890,469 | A * | 4/1999 | Hakansson et al. | 123/321 |
| 5,975,251 | A * | 11/1999 | McCarthy | 188/31 |
| 6,415,752 | B1 * | 7/2002 | Janak | 123/90.12 |
| 2003/0024501 | A1 | 2/2003 | McCarthy | |
| 2004/0168660 | A1 | 9/2004 | Persson et al. | |
| 2006/0005796 | A1 | 1/2006 | Janak | |

FOREIGN PATENT DOCUMENTS

| | | | |
|---|---|---|---|
| DE | 40 25 569 | C1 | 7/1991 |
| DE | 199 61 795 | | 6/2000 |
| DE | 639 29 064 | T2 | 3/2001 |
| WO | WO 93/25803 | | 12/1993 |
| WO | WO 94/25740 | | 11/1994 |
| WO | WO 96/29508 | | 9/1996 |
| WO | WO 01/46578 | A1 | 6/2001 |
| WO | WO 03/031778 | A1 | 4/2003 |
| WO | WO 2005/080773 | A1 | 9/2005 |

* cited by examiner

*Primary Examiner* — Stephen K Cronin
*Assistant Examiner* — Raza Najmuddin
(74) *Attorney, Agent, or Firm* — Klaus J. Bach

(57) ABSTRACT

In a gas exchange valve actuating device for transmitting a drive movement to at least one gas exchange valve of an internal combustion engine which includes a braking unit having at least one actuator, the gas exchange valve actuating device is provided with a locking unit for locking the actuator counter to an opposing force when the actuator has reached a specific position.

7 Claims, 4 Drawing Sheets

GAS EXCHANGE VALVE ACTUATING DEVICE

This is a Continuation-In-Part Application of pending International patent application PCT/EP2007/002932 filed Apr. 2, 2007 and claiming the priority of German patent application 10 2006 015 893.8 filed Apr. 5, 2006.

BACKGROUND OF THE INVENTION

The invention relates to a gas exchange valve actuating device for transmitting an actuating movement to a gas exchange valve.

DE 693 29 064 T2 discloses a gas exchange valve actuating device for transmitting a drive movement to a gas exchange valve, in an internal combustion engine braking system which comprises a hydraulic actuator means. In order to avoid undesirably large forces, the combustion engine braking system includes an overpressure valve.

It is the principal object of the present invention to provide a gas exchange valve actuating device which is not sensitive to impulses during operation and in which nevertheless undesirably large forces can advantageously be avoided.

SUMMARY OF THE INVENTION

In a gas exchange valve actuating device for transmitting a drive movement to at least one gas exchange valve of an internal combustion engine which includes a braking unit having at least one actuator, the gas exchange valve actuating device is provided with a locking unit for locking the actuator counter to an opposing force when the actuator has reached a specific position.

Before the locking occurs by means of the locking unit, adjustment of the actuator can be permitted and it is possible to avoid a situation in which the actuator moves out completely just before a top dead center of an internal combustion engine piston and undesirably large forces occur owing to high cylinder pressures. In addition, when the actuator means is locked, undesired distribution of the actuator means when impulses occur can reliably be avoided with the result that, in particular even at high rotational speeds, an advantageous braking effect can be achieved. "Provided" is to be understood here in particular as meaning specially equipped and/or configured.

If the actuator means is formed by an actuator piston which can be actuated hydraulically and/or if the locking unit is of hydraulic design, the latter can be configured in a way which is particularly structurally simple and also cost-effective considering the large forces which generally occur. The term "locking unit of hydraulic design" is to be understood to mean in particular a unit which utilizes hydraulic fluid for locking purposes.

Various means, which appear appropriate to a person skilled in the art, are conceivable for limiting, to a desired degree, the forces which occur before the locking process, said means being, for example, a pressure-limiting valve or, particularly advantageously, at least one bypass via which pressure medium can flow up to the specific position of the actuator means, as a result of which undesirably large forces can be avoided in a structurally simple way and the locking unit can be implemented in a structurally simple way. In particular, by means of a corresponding refinement it is possible to avoid pressure limiting valves which have to be configured particularly precisely, and to avoid the costs which such valves entail.

If at least one pressure-limiting valve is arranged in the bypass, losses via the bypass can advantageously at least be reduced.

In a particular embodiment of the invention, the bypass is arranged at least partially in the actuator means, as a result of which the latter can be integrated in a particularly space-saving fashion.

Preferably, the gas exchange valve actuating device has at least one energy storage unit which is provided for storing energy during a compensating movement of the actuator. With an appropriate configuration it is possible to permit the actuator to move out over a plurality of working cycles, in particular over more than 720° of a crankshaft, and it is also possible overall to permit particularly rapid moving-out of the actuator after a first compensating movement. An overall activation time of the internal combustion engine braking unit can be reduced.

The energy storage unit is preferably formed by a hydraulic pressure accumulator, which can be provided in a structurally simple way, in particular if the actuator is formed by an actuator piston which can be actuated hydraulically and/or the locking unit is a hydraulic device. The term "hydraulic pressure accumulator unit" is to be understood to mean in this context in particular a storage unit in which hydraulic pressure medium can be stored, in particular under pressure.

If the energy storage unit has at least one mechanical spring element, the energy storage unit can be configured in a structurally simple and flexible way.

Arranging the spring element at least partially inside the actuator can save installation space.

The invention will become more readily apparent from the following description of exemplary embodiments of the invention on the basis of the accompanying drawings.

DESCRIPTION OF VARIOUS EMBODIMENTS

Figure 1:
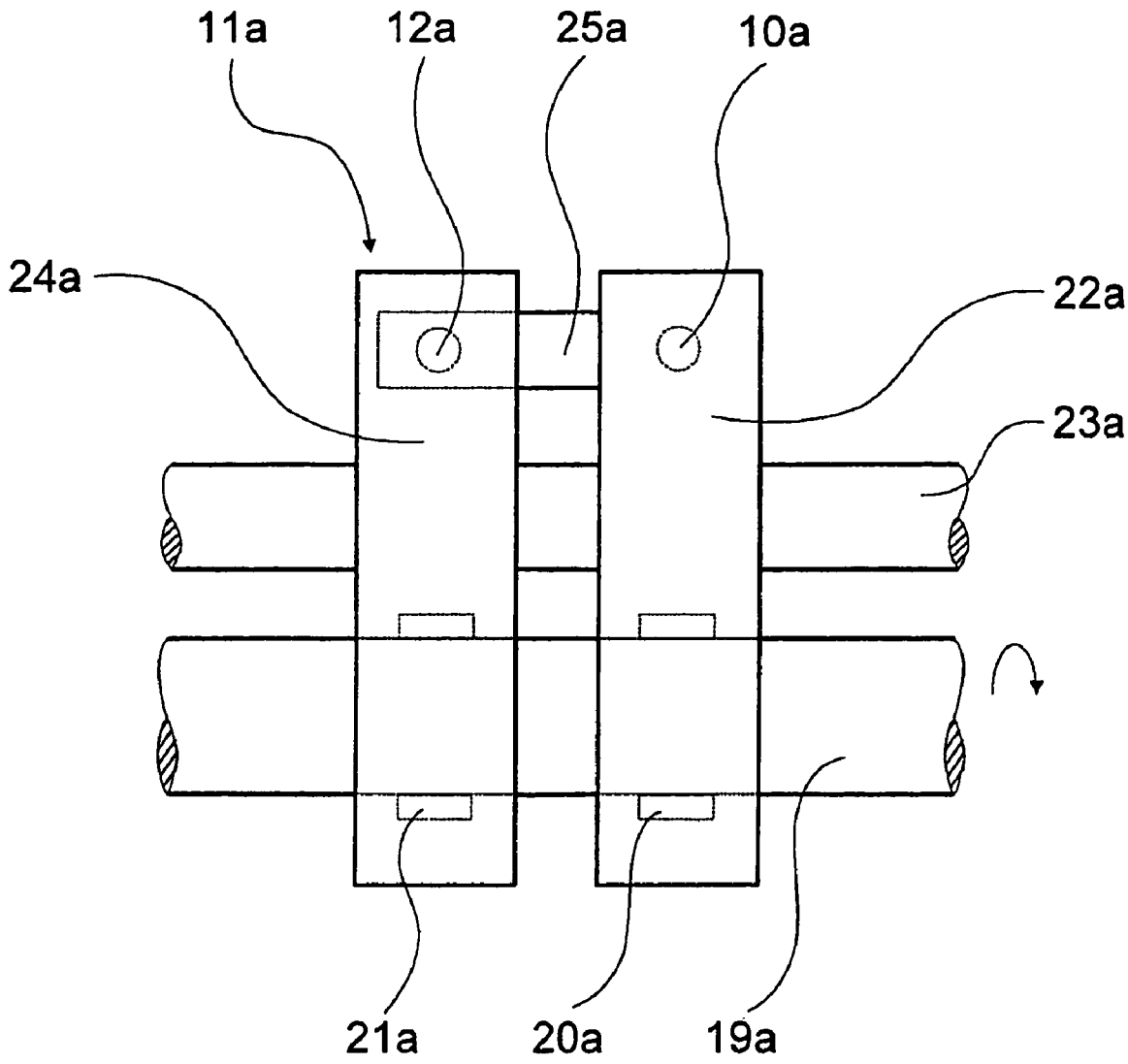
FIG. 1 shows integral parts of a gas exchange valve actuating device.

FIG. 1 shows individual parts of a gas exchange valve actuating device of an internal combustion engine which is provided for transmitting a drive movement to gas exchange valves 10*a*, with just one gas exchange valve 10*a* being indicated. The gas exchange valve actuating device comprises a camshaft 19*a* with an outlet valve actuating cam 20*a* and a brake cam 21*a* of an internal combustion engine braking valve unit 11*a*. The outlet valve actuating cam 20*a* acts on a first end of an outlet rocker lever 22*a* which is pivotally mounted on a rocker lever support shaft 23*a* and acts with its second end on the gas exchange valve 10*a* which is for example an outlet valve.

The brake valve actuator cam 21*a* is arranged on the camshaft 19*a* in the region of a brake rocker lever 24*a* of the internal combustion engine braking unit 11*a*. The brake rocker lever 24*a* is likewise mounted so as to be pivotable on a rocker lever shaft 23*a* so that it is pivotable relative to the brake rocker lever 24*a* outside a braking operation.

Figure 2:
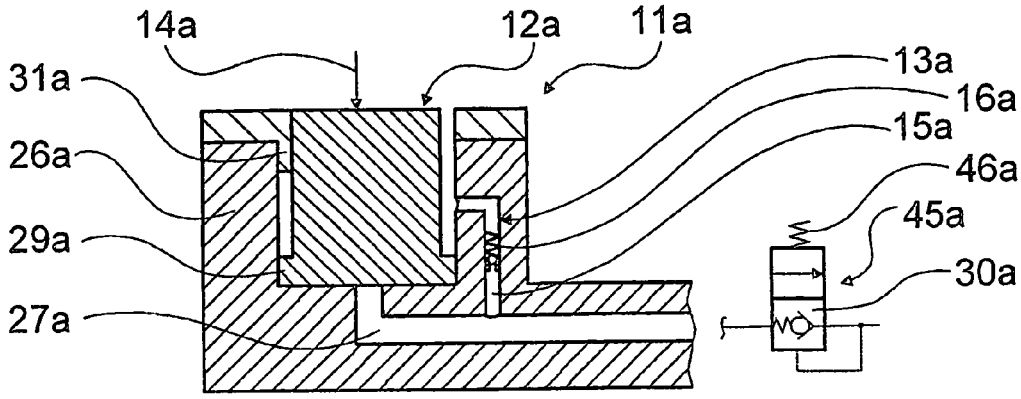
FIG. 2 shows an actuator unit of an internal combustion engine braking unit of the gas exchange valve actuating device in the deactivated position.

The brake rocker lever 24*a* has, at its end facing the gas exchange valve 10*a*, a transverse arm 25*a* which extends under the brake rocker lever 24*a* transversely with respect to the brake rocker lever 24*a* or parallel with respect to the rocker lever support shaft 23*a* in the direction toward the outlet valve rocker lever 22*a*. An actuator unit with an actuator means 12*a* which is formed by an actuator piston which can be actuated hydraulically is arranged between the transverse arm 25*a* and the brake rocker lever 24*a* (FIGS. 1 and 2). The actuator 12*a* is guided in a housing 26*a* of the actuator unit.

According to the invention, the actuator unit has a hydraulic locking unit 13*a*, which is provided for locking the actuator 12*a* counter to an opposing force 14*a* starting from a specific position of the actuator means 12*a*. The locking unit 13*a* has a bypass 15*a* which is formed by a duct which is provided in the housing 26*a*, via which a bypass 15*a* pressure medium can be discharged up to the specific position of the actuator 12*a*.

Before the braking operation is initiated, the actuator 12*a* is in its lower position as a result of the force of gravity acting on the actuator means 12*a* or due to the force of a spring (not illustrated). The gas exchange valve 10*a* is opened by the outlet valve cam 20*a* via the outlet rocker lever 22*a* independently of the brake cam 21*a*, and is closed by means of a valve spring (not illustrated in more detail) which acts in the closing direction on the gas exchange valve 10*a*.

Figure 3:
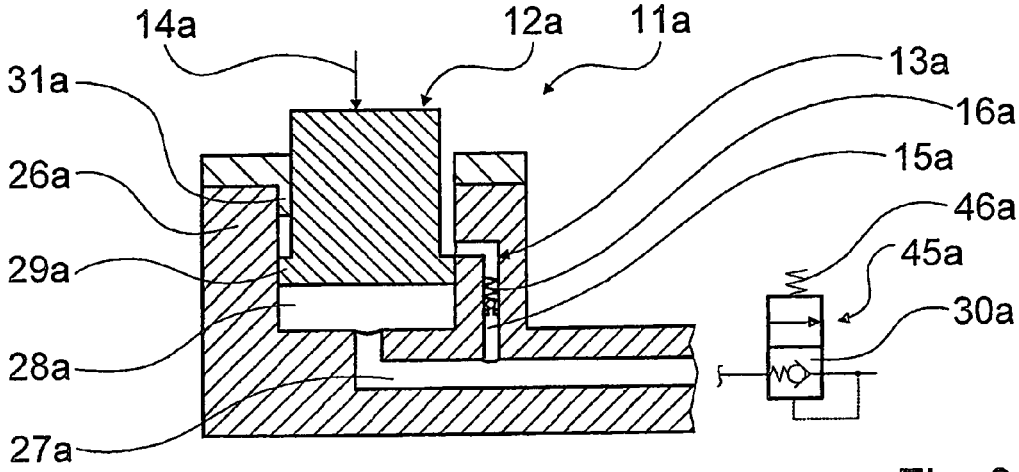
FIG. 3 shows the actuator unit of FIG. 2 with the actuator partially extended.

When the braking operation is activated, a 2/2 way valve 45*a* is switched by means of a build up in pressure and pressure medium flows via a non-return valve 30*a* of the 2/2 way valve 45*a* and via an inflow duct 27*a* into a pressure chamber 28*a* underneath the actuator 12*a*, so that the actuator 12*a* moves out of the housing 26*a* (FIG. 3).

If the rocker levers 22*a*, 24*a* are coupled via the actuating unit before the actuator 12*a* moves fully out, so that a force which is brought about by the brake cam 21*a* acts on the actuator unit via the brake rocker lever 24*a* and, as a result, an opposing force 14*a* acts on the actuator 12*a*, pressure medium can be discharged from the pressure space 28*a* via the inflow duct 27*a* and via the bypass 15*a* with the result that the actuator 12*a* can carry out a compensating movement in the direction of the opposing force 14*a*, which avoids undesirably large forces on the gas exchange valve actuating device. In order to avoid undesirable losses when the actuator 12*a* moves out before the rocker levers 22*a*, 24*a* are coupled via the bypass 15*a*, a pressure-limiting valve 16*a* is arranged in the bypass 15*a*. The pressure-limiting valve 16*a* is closed without an opposing force or without a significant opposing force when the actuator 12*a* moves out, and said pressure-limiting valve 16*a* opens when the actuator 12*a* moves out at a pressure slightly above a maximum system pressure in the inflow duct 27*a* of the internal combustion engine, or when the rocker levers 22*a*, 24*a* are coupled during the moving-out of the actuator 12*a*. It is, however, basically also conceivable for a bypass to be provided without a corresponding pressure-limiting valve 16*a*.

Figure 4:
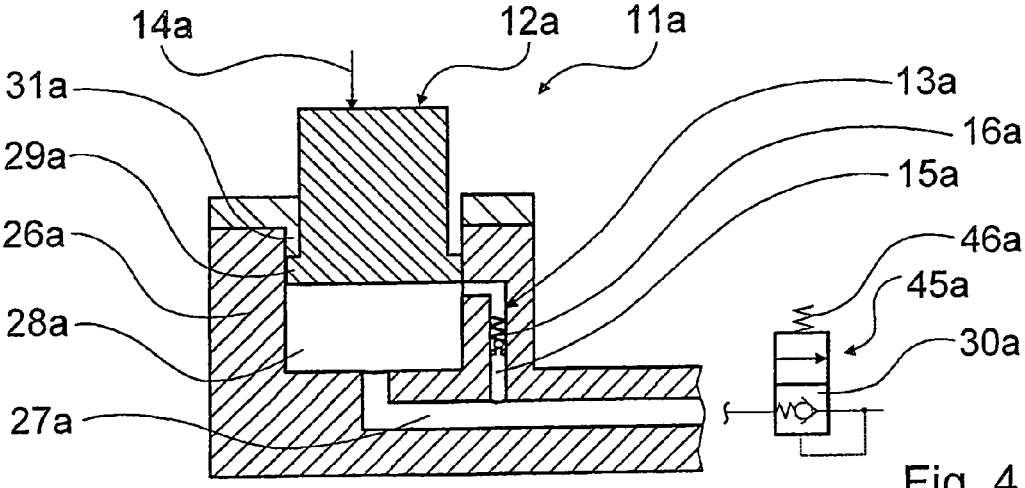
FIG. 4 shows the actuator unit of FIG. 2 with the actuator extended slightly further than in FIG. 3.

If the actuator 12*a* moves out completely before the rocker levers 22*a*, 24*a* are coupled via the actuator unit and a force which is generated by the brake cam 21*a* acts on the actuator unit via the brake rocker lever 24*a* and as a result the opposing force 14*a* acts on the actuator means 12*a*, the actuator 12*a*, is locked by the locking unit 13*a*, specifically by virtue of the fact that the bypass 15*a* is in communication at both ends with the pressure space 28*a* or the bypass 15*a* connects the pressure space 28*a* to the inflow duct 27*a*, and it is prevented thereby that pressure medium can be discharged via the bypass 15*a* (FIG. 4). In the completely moved out state, the actuator means 12*a* comes to bear with its guide collar 29*a* against a stop 31*a*.

If an opening force which is generated by the brake cam 21*a* acts on the actuator unit via the brake rocker lever 24*a*, the non-return valve 30*a* closes and the opening force can be transmitted to the outlet tilting lever 22*a* via the actuator unit and the transverse arm 25*a*, and to the gas exchange valve 10*a* via the outlet rocker lever 22*a*, and the gas exchange valve 10*a* can be opened at crankshaft angles which are predefined by the brake cam 21*a*.

If the braking operation is deactivated, the pressure upstream of the 2/2 way valve 45*a* drops and the 2/2 way valve 45*a* is switched back into its starting position, driven by a spring force of a spring element 46*a*, with the result that the pressure medium can be discharged from the pressure space 28*a* via the inflow duct 27*a* and via the 2/2 way valve 45*a*.

The inflow duct 27*a* and the bypass 15*a* are dimensioned in such a way that at any pressure medium temperature or oil temperature which will possibly occur during operation and given any rotational speed of the internal combustion engine which will possibly occur during operation, the actuator 12*a* can move out completely in one working cycle, reduced by an opening time of the gas exchange valve 10*a*.

FIGS. 5 to 8 illustrate alternative exemplary embodiments. Components, features and functions which remain essentially the same are provided with the same reference signs. However, in order to differentiate the exemplary embodiments, the letters a to e are added to the reference numerals of the exemplary embodiments. The following description is limited essentially to the differences from the exemplary embodiment shown in FIGS. 1 to 4, in which case reference can be made to the description of the exemplary embodiment shown in FIGS. 1 to 4 for components, features and functions which remain the same.

Figure 5:
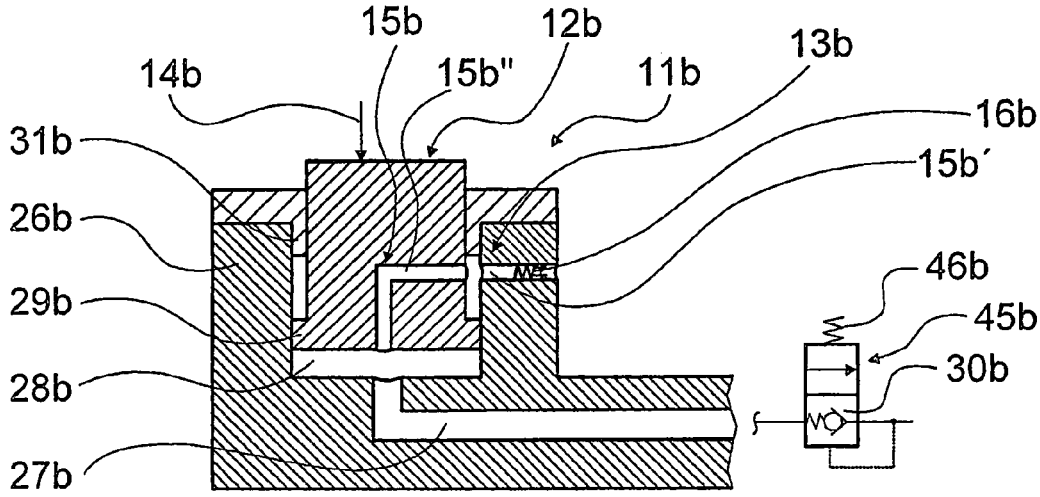
FIG. 5 shows an alternative actuator unit with a bypass which is partially integrated in an actuator.

FIG. 5 illustrates an alternative actuator unit with a locking unit 13*b* which has a bypass 15*b* which is partially arranged within an actuator 12*b*. Before the actuator 12*b* moves out completely, pressure medium can be discharged from a pressure space 28*b* via the bypass 15*b*. If the actuator 12*b* moves out completely, a duct section 15*b*' of the bypass 15*b* in a housing 26*b* of the actuator unit is closed off from the outside by a guide collar 29*b* of the actuator 12*b*, and a duct section 15*b*" of the bypass 15*b* is closed off from the outside by a stop 31*b*, and the actuator 12*b* is locked.

Figure 6:
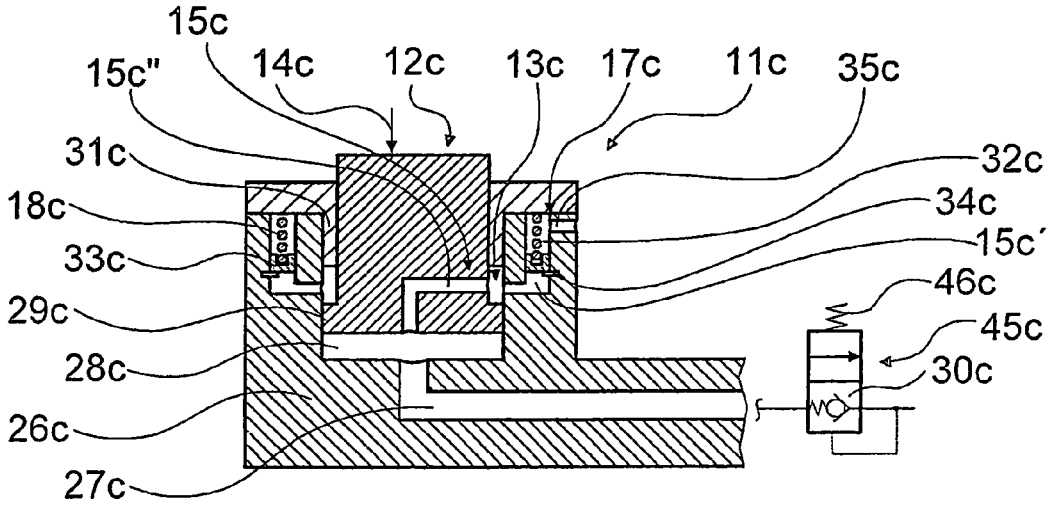
FIG. 6 shows an alternative actuator unit with an energy storage structure.

FIG. 6 illustrates an alternative actuator unit with a locking unit 13*c* which has a bypass 15*c* which is arranged partially in an actuator 12*c*. In addition, the actuator unit has an energy storage unit 17*c* which is formed by a hydraulic pressure storage unit and which is provided for storing energy during a compensating movement of the actuator 12*c*. The energy storage unit 17*c* has, in an annular space 32*c* of a housing 26*c* of the actuator unit, a mechanical spring element 18*c* which is formed by a coil compression spring and is supported at a first end on a component which forms a stop 31*c*, and at a second end, on a spring disk 33*c*. The spring disk 33*c* is secured by a spring washer 34*c* in the direction facing away from the spring element 18*c* and the spring disk 33*c* is guided so as to be displaceable in the annular space 32*c* in the direction of the spring element 18*c* counter to a spring force of the spring element 18*c*. In this context, an abutment at the stop 31*c* prevents the spring element 18*c* from being compressed to the full extent.

Before the braking operation is activated, the actuator 12*c* is in its lower position owing to the force of gravity acting on the actuator means 12*c* or due to the force of a spring (not illustrated).

When the braking operation is initiated, pressure medium flows via an inflow duct 27*c* into a pressure space 28*c* underneath the actuator 12*c*, and the actuator 12*c* moves out of the housing 26*c* (FIG. 6).

If rocker levers which correspond to the exemplary embodiment in FIGS. 1 to 4 are coupled via the actuator unit before the actuator 12*c* moves out virtually completely with the result that a force which is brought about by a brake cam acts on the actuator unit via a brake rocker lever and as a result an opposing force 14*c* acts on the actuator 12*c*, pressure medium can flow out of the pressure space 28*c* via the bypass 15*c* and into the annular space 32*c* which forms a pressure medium space. In this context, the spring disk 33*c* is displaced counter to the spring force of the spring element 18*c*, and the actuator 12*c* carries out a compensating movement in the direction of action of the opposing force 14*c*, as a result of which undesirably large forces are avoided. If the opposing force 14*c* is eliminated again, the spring element 18*c* relaxes and forces the pressure medium out of the annular space 32*c* and back into the pressure space 28*c*, as a result of which the actuator 12*c* moves out particularly quickly again to its position at which it was located before the coupling of the rocker levers. The actuator 12*c* can be extended further up to the next time the rocker levers are coupled. A kind of iterative moving-out of the actuator means 12*c*, in particular even over several working cycles, can be achieved.

When the actuator 12*c* moves out completely, the actuator 12*c* is locked by means of the locking unit 13*c*, specifically by closing a duct section 15*c*' of the bypass 15*c* by means of a guide collar 29*c* of the actuator 12*c* and a duct section 15*c*" of the bypass 15*c* by means of the stop 31*c*, with the result that pressure medium is prevented from being discharged from the pressure space 28*c* via the bypass 15*c* and into the annular space 32*c*. In order to avoid a build up of pressure in the region of the spring element 18*c* due to leakage, the annular space 32*c* is connected via a duct 35*c* to a space which adjoins the actuator unit.

Figure 7:
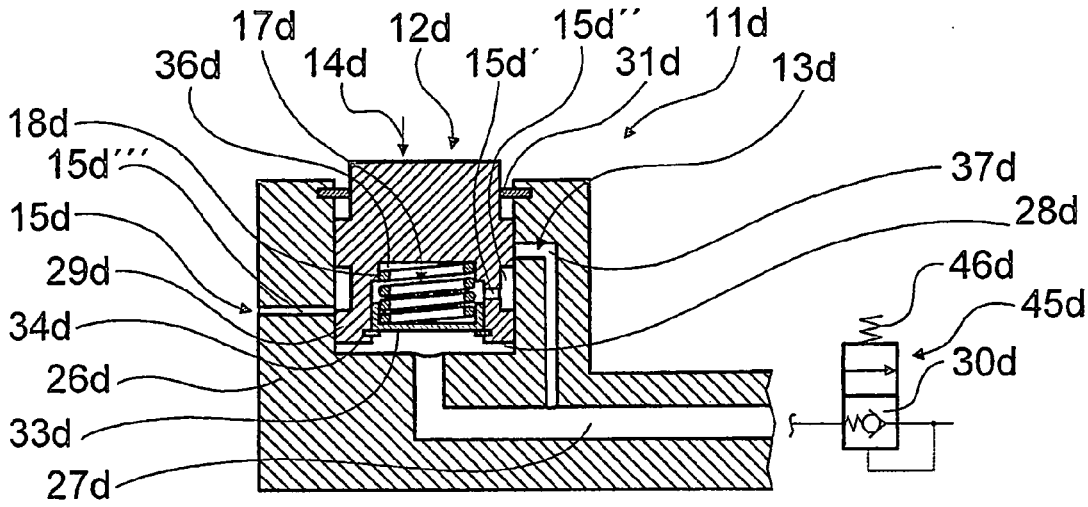
FIG. 7 shows an alternative actuator unit with an energy storage structure which is integrated in the actuator.

FIG. 7 illustrates an alternative actuator unit with a locking unit 13*d* which has a bypass 15*d* which is partially arranged in an actuator 12*d*. In addition, the actuator unit has an energy storage unit 17*d* which is formed by a hydraulic pressure storage unit and which is provided for storing energy during a compensating movement of the actuator 12*d*. The energy storage unit 17*d* has, within the actuator 12*d* in a spring space 36*d*, a mechanical spring element 18*d* which is formed by a coil compression spring and is supported at a first end on an underside of the actuator and at a second end on a spring disk 33*d*. The spring disk 33*d* is secured in the actuator 12*d* in the direction facing away from the spring element 18*d* by a spring ring 34*d* and is guided in the actuator means 12*d* in such a way that it can be displaced in the direction of the spring element 18*d*, counter to a spring force of the spring element 18*d*. In this context, a stop (not illustrated in more detail) in the actuator 12*d* pre-vents the spring element 18*d* from being compressed to the full extent.

Before the braking operation is initiated, the actuator 12*d* is in its lower position owing to the force of gravity acting on the actuator 12*d* or due to the force of a spring (not illustrated).

When the braking operation is initiated, pressure medium flows via an inflow duct 27*d* into a pressure space 28*d* underneath the actuator 12*d* and/or underneath the spring disk 33*d*, and the actuator means 12*d* moves out of the housing 26*d* (FIG. 7).

When the rocker levers which correspond to the exemplary embodiment shown in FIGS. 1 to 4 are coupled via the actuator unit before the actuator 12*d* has moved out virtually completely, with the result that a force which is brought about by a brake cam acts on the actuator unit via a brake rocker lever and as a result an opposing force 14*d* acts on the actuator 12*d*, the spring element 18*d* is compressed and pressure medium can be discharged from the spring space 36*d* via the bypass 15*d*, specifically via a duct section 15*d*' in the actuator 12*d*, an annular space 15*d*" between the actuator means 12*d* and the housing 26*d* and via a duct section 15*d*'" in the housing 26*d*. In the process, the spring plate 33*d* is displaced counter to the spring force of the spring element 18*d*, and the actuator 12*d* carries out a compensating movement in the direction of action of the opposing force 14*d*, as a result of which undesirably large forces are avoided. If the opposing force 14*d* is eliminated again, the spring element 18*d* relaxes and the actuator 12*d* is pushed back to its position at which it was located before the coupling of the rocker levers. In this context it is also possible in particular to suck in air via the bypass 15*d*. The actuator 12*d* can be moved out further up to the next time the tilting levers are coupled.

When the actuator 12*d* is completely moved out, the actuator means 12*d* is locked by means of the locking unit 13*d*, specifically by virtue of the fact that the bypass 15*d* and/or the duct section 15*d*'" is/are closed by a guide collar 29*d* of the actuator 12*d*, with the result that pressure medium is prevented from being discharged from the spring space 36*d* via the bypass 15*d*. In addition, when the actuator means 12*d* is completely moved out, the spring space 36*d* is connected via a duct 37*d* to the inflow duct 27*d* with the result that remaining air is forced out of the spring space 36*d* during operation by a pumping effect, the spring space 36*d* is completely filled with hydraulic pressure medium from the inflow duct 27*d*, and the actuator means 12*d* can be locked by means of the hydraulic pressure medium.

Figure 8:
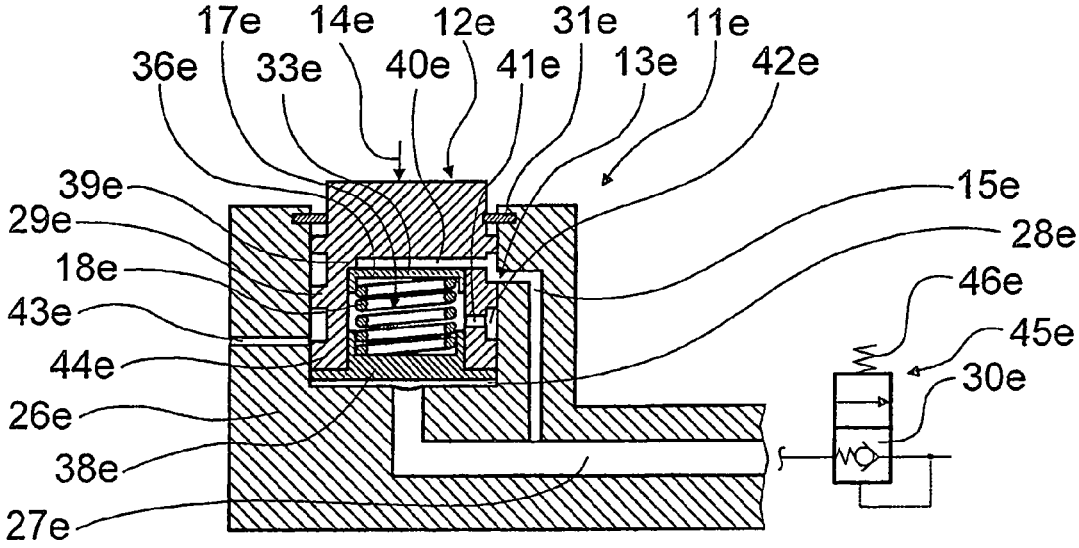
FIG. 8 shows another alternative actuator unit with an energy storage structure which is integrated in an actuator.

FIG. 8 illustrates an alternative actuator unit with a locking unit 13*e* which has a bypass 15*e*. In addition, the actuator unit has an energy storage unit 17*e* which is formed by a hydraulic pressure storage unit and which is provided for storing energy during a compensating movement of an actuator 12*e*. The energy storage unit 17*e* has, in a spring space 36*e* inside the actuator 12*e*, a mechanical spring element 18*e* which is formed by a coil compression spring and which is supported, at a first end facing a supporting face of the actuator 12*e* for a tilting lever, on a spring disk 33*e* which is mounted in the actuator 12*e*, and at a second end on a lid 38*e* which is attached in the actuator 12*e*. The spring disk 33*e* is secured by a shoulder 39*e* of the actuator 12*e* in the direction facing away from the spring element 18*e* and is guided so as to be displaceable in the actuator 12*e* in the direction of the spring element 18*e*, counter to a spring force of the spring element 18*e*. In this context, a stop (not illustrated in more detail) in the lid 38*e* pre-vents the spring element 18*e* from being compressed to the full extent.

Before the braking operation is initiated, the actuator 12*e* is in its lower position owing to the force of gravity acting on the actuator 12*e* or due to the force of a spring (not illustrated).

When the braking operation is initiated, pressure medium flows via an inflow duct 27*e* into a pressure space 28*e* underneath the actuator 12*e* and/or underneath the lid 38*e*, and the actuator 12*e* moves out of a housing 26*e* (FIG. 8).

When the rocker levers which correspond to the exemplary embodiment in FIGS. 1 to 4 are coupled via the actuator unit before the actuator 12*e* has moved out virtually completely, with the result that a force which is brought about by a brake cam acts on the actuator unit via a brake rocker lever and as a result an opposing force 14*e* acts on the actuator 12*e*, the spring element 18*e* is compressed, and pressure medium can flow from the pressure space 28*e* into a pressure space 40*e* in the actuator 12*e* via the inflow duct 27*e* and via the bypass 15*e*. In this context, the spring disk 33*e* is pushed counter to the spring force of the spring element 18*e*, and the actuator 12*e* carries out a compensating movement in the direction of action of the opposing force 14*e*, as a result of which undesirably large forces are avoided. If the opposing force 14*e* is eliminated again, the spring element 18*e* relaxes, the pressure medium is pushed out of the pressure space 14*e* via the bypass 15*e* and via the inflow duct 27*e* into the pressure space 28*e*, and the actuator 12*e* is pushed back to its position at which it was located before the coupling of the tilting levers. The actuator 12*e* can be moved out further up to the next time the tilting levers are coupled. In order to avoid a build up of pressure in the spring space 36*e* due to leakage, the spring space 36*e* is connected via a duct 41*e*, an annular space 42*e* and via a duct 43*e* to a space which adjoins the actuator unit.

When the actuator 12*e* is completely moved out, the actuator 12*e* is locked by means of the locking unit 13*e*, specifically by virtue of the fact that the bypass 15*e* is closed by means of a guide collar 29*e* of the actuator 12*e*, with the result that pressure medium is prevented from being discharged from the pressure space 28*e* into the pressure space 40*e* in the actuator 12*e* via the bypass 15*e*. In addition, the duct 43*e* is closed by means of a guide collar 44*e* of the actuator 12*e*.

What is claimed is:

1. A gas exchange valve actuating device for transmitting a drive movement of an actuator to at least one gas exchange valve (10*a*) of an internal combustion engine including an internal combustion engine braking unit (11*a*; 11*b*; 11*c*; 11*d*; 11*e*) having at least one actuator means (12*a*; 12*b*; 12*c*; 12*d*; 12*e*), said gas exchange valve actuating device comprising a locking unit (13*a*; 13*b*, 13*c*; 13*d*; 13*e*) for locking the actuator (12*a*; 12*b*; 12*c*; 12*d*; 12*e*) counter to an opposing force (14*a*; 14*b*; 14*c*; 14*d*; 14*e*) when the actuator (12*a*; 12*b*; 12*c*; 12*d*; 12*e*) has reached a specific position, the actuator (12*a*; 12*b*; 12*c*; 12*d*; 12*e*) comprising a hydraulically operable actuator piston, the locking unit (13*a*; 13*b*, 13*c*; 13*d*; 13*e*) being a hydraulic unit operated by a hydraulic pressure medium supplied to a pressure space (28*a*, 28*b*, 28*c*, 28*d*, 28*e*) below the actuator (12*a*, 12*b*, 12*c*, 12*d*, 12*e*) and the locking unit (13*a*; 13*b*, 13*c*; 13*d*; 13*e*) having at least one bypass (15*a*; 15*b*; 15*c*; 15*d*; 15*e*) which is open for discharging the hydraulic pressure medium until the actuator (12*a*) reaches a specific position wherein the bypass is closed or ineffective so that the actuator 12*a* is locked in the specific position.

2. The gas exchange valve actuating device as claimed in claim 1, wherein at least one pressure-limiting valve (16*a*; 16*b*) is arranged in the bypass (15*a*; 15*b*).

3. The gas exchange valve actuating device as claimed in claim 1, wherein the bypass (15*b*; 15*c*; 15*d*) is provided at least partially in the actuator (12*b*; 12*c*; 12*d*).

4. The gas exchange valve actuating device as claimed in claim 1, wherein at least one energy storage unit (17*c*; 17*d*; 17*e*) is provided for storing energy during a compensating movement of the actuator (12*c*; 12*d*; 12*e*).

5. The gas exchange valve actuating device as claimed in claim 4, wherein the energy storage unit (17*c*; 17*d*; 17*e*) is formed by a hydraulic pressure accumulator unit.

6. The gas exchange valve actuating device as claimed in claim 4, wherein the energy storage unit (17*c*; 17*d*; 17*e*) includes a mechanical spring element (18*c*; 18*d*; 18*e*).

7. The gas exchange valve actuating device as claimed in claim 6, wherein the mechanical spring element (18*d*; 18*e*) is arranged at least partially inside the actuator (12*d*; 12*e*).

* * * * *